US012017812B2

(12) United States Patent
Iwasa et al.

(10) Patent No.: US 12,017,812 B2
(45) Date of Patent: Jun. 25, 2024

(54) BOX PACKING APPARATUS

(71) Applicant: ISHIDA CO., LTD., Kyoto (JP)

(72) Inventors: Tatsuya Iwasa, Ritto (JP); Satoshi Nishitsuji, Ritto (JP); Yoshinobu Shimomae, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 0 days.

(21) Appl. No.: 18/183,186

(22) Filed: Mar. 14, 2023

(65) Prior Publication Data

US 2023/0294856 A1 Sep. 21, 2023

(30) Foreign Application Priority Data

Mar. 17, 2022 (JP) ..... 2022-042959

(51) Int. Cl.
*B65B 5/10* (2006.01)
*B65B 7/20* (2006.01)
(Continued)

(52) U.S. Cl.
CPC ..... *B65B 5/106* (2013.01); *B65B 7/20* (2013.01); *B65B 35/50* (2013.01); *B65B 43/10* (2013.01); *B65B 43/54* (2013.01)

(58) Field of Classification Search
CPC ..... B65B 5/106; B65B 7/20; B65B 59/003; B65B 5/024; B65B 5/06; B65B 35/405;
(Continued)

(56) References Cited

U.S. PATENT DOCUMENTS 4,517,791 A * 5/1985 Focke ..... B65B 35/58 198/374
5,732,536 A * 3/1998 Lin ..... B65B 5/106 53/247

(Continued)

FOREIGN PATENT DOCUMENTS

EP 1050464 A1 * 11/2000 ..... B65B 35/22
EP 1050464 A1 11/2000

(Continued)

OTHER PUBLICATIONS

The Search Report from the corresponding European Patent Application No. 23161395.1 issued on Oct. 6, 2023.

*Primary Examiner* — Thomas M Wittenschlaeger
*Assistant Examiner* — Himchan Song
(74) *Attorney, Agent, or Firm* — United IP Counselors, LLC

(57) ABSTRACT

A box packing apparatus includes a transport unit configured to transport a group of articles arranged in a state in which at least some of the articles overlap with each other to a predetermined position, a holding unit configured to hold a cardboard box having an opening with long sides and short sides, and a transfer unit configured to transfer the group of articles from the predetermined position into the cardboard box. The holding unit can hold the cardboard box in a first posture in which the long side is located downward and the opening is directed laterally. The transfer unit transfers the group of articles in a state in which rows of the group of articles are arranged in a row along the long side of the cardboard box.

6 Claims, 7 Drawing Sheets

(51) Int. Cl.
*B65B 35/50* (2006.01)
*B65B 43/10* (2006.01)
*B65B 43/54* (2006.01)

(58) Field of Classification Search
CPC ..... B65B 35/50; B65B 43/10; B65B 43/265; B65B 43/44; B65B 43/54; B65B 51/067; B65B 57/12; B65B 2220/18; B65B 43/60; B65B 43/62
See application file for complete search history.

(56) References Cited

U.S. PATENT DOCUMENTS

| | | | | |
|---|---|---|---|---|
| 2013/0283731 | A1* | 10/2013 | Komp | B65B 35/38 53/268 |
| 2015/0203228 | A1* | 7/2015 | Johnson | B65B 43/39 198/339.1 |
| 2019/0263545 | A1* | 8/2019 | Yokota | B65B 43/54 |
| 2019/0263547 | A1* | 8/2019 | Tatsukawa | B65B 7/2864 |

FOREIGN PATENT DOCUMENTS

| | | | |
|---|---|---|---|
| EP | 2045187 | A1 | 4/2009 |
| EP | 3248892 | A1 | 11/2017 |
| EP | 3578470 | A1 | 12/2019 |
| JP | 2019-147582 | A | 9/2019 |
| JP | 2019-147584 | A | 9/2019 |
| KR | 10-1402091 | B1 | 6/2014 |

* cited by examiner

BOX PACKING APPARATUS

TECHNICAL FIELD

The present disclosure relates to a box packing apparatus.

BACKGROUND

Conventionally, as described in Patent Document 1, a box packing apparatus that assembles (manufactures) a cardboard box so that it has an opening on one surface, inserts aligned products into the cardboard box, then closes the opening with flaps, and seals it with tape is known. A predetermined number of products are aligned so that a part of each of the products overlaps a part of an adjacent product in a thickness direction, and are accumulated on a conveyor. The cardboard box stands by in a posture in which the opening is directed laterally. The products aligned in a row are pushed into the cardboard box through the opening by a moving insert plate.

[Patent Document 1] Japanese Unexamined Patent Publication No. 2019-147582

SUMMARY

Normally, a cardboard box has a rectangular parallelepiped shape and has long sides and short sides in a plan view (in a posture in which the opening is directed upward). In the apparatus described above, the cardboard boxes are handled in a state in which their long sides coincide with a transporting direction. The cardboard box waiting for the insertion of products is adjusted to a posture in which the short sides are located downward. The aligned products are stored in the cardboard box in a state in which they are aligned in a direction of the short sides (along the short sides). In a conventional apparatus, aligned products (articles) are inserted in a direction of the long side of the cardboard a plurality of times, that is, in a plurality of stages. With such a large number of stages, it is difficult to increase a box packing capacity.

The present disclosure describes a box packing apparatus capable of enhancing a box packing capacity by also enabling box packing in which articles are arranged in a direction of a long side.

An aspect of the present disclosure includes a transport means configured to transport a group of articles arranged in a state in which at least some of the articles overlap with each other to a predetermined position, a holding means configured to hold a cardboard box having an opening with long sides and short sides, and a transfer means configured to transfer the group of articles from the predetermined position into the cardboard box. The holding means is configured to hold the cardboard box in a first posture in which the long side is located downward and the opening is directed laterally. The transfer means transfers the group of articles in a state in which rows of the group of articles are arranged in a row along the long side of the cardboard box.

According to the box packing apparatus, the cardboard box is held in the first posture in which the long side is located downward, unlike the conventional cardboard box. The rows of the group of articles are stored in a row along the long side of the cardboard box by the transferring means. The number of articles that can be stored at one time is greater than before, and the number of stages is reduced because it corresponds to the short side. Thus, in this box packing apparatus, a box packing capacity can be enhanced by enabling box packing in which the products are arranged in a direction of the long side.

The box packing apparatus may further include a supply means configured to supply the cardboard box to a holding position at which the cardboard box is held by the holding means. The supply means may include a first rotation part that selectively rotates the cardboard box after box manufacturing to the first posture or to a second posture in which the short side is located downward and the opening is directed laterally. The cardboard box can be rotated into two different postures by the first rotation part of the supply means. Therefore, variations regarding the form of box packing are widened.

In the first rotation part, any one of the first posture and the second posture may be selected according to a type of the cardboard box. The appropriate orientation in which the rows of the group of products should be arranged may vary according on the type of the cardboard box and the type of the product. According to the above configuration, the box packaging is performed in an appropriate manner.

The box packing apparatus may further include a box sealing means configured to close the opening of the cardboard box storing the group of articles with a flap and to apply a tape. The box sealing means may include a second rotation part that rotates the cardboard box so that a transporting direction of the cardboard box is aligned with an application direction in which the tape is applied. According to the second rotation part of the box sealing means, even when the box packing in which the articles are arranged in the direction of the long side is performed, the tape can be easily applied as in the conventional case.

When the cardboard box is held in the first posture, the second rotation part may rotate the cardboard box by 90 degrees about an axis extending in a vertical direction so that the long side is directed in the transporting direction. With such a configuration, changes from the conventional apparatus are minimized.

According to the present disclosure, it is possible to increase the box packing capacity by enabling box packing in which the articles are arranged in the direction of the long side.

DETAILED DESCRIPTION

Hereinafter, embodiments of the present disclosure will be described with reference to the drawings. In the following description, directions of forward and backward, upward and downward, and left and right with respect to a box packing apparatus 1 are used for convenience. In some drawings, three-dimensional orthogonal axes are displayed to indicate the directions. As an example, a front portion of the box packing apparatus 1 is a position at which a piece of box material Z is placed and a position at which a sealed cardboard box B is discharged. A position at which a product supply means 50 is provided is a rear portion of the box packing apparatus 1. Both a forward-rearward direction and a left-right direction are directions that extend horizontally. An upward-downward direction is equal to a vertical direction.

Figure 1:
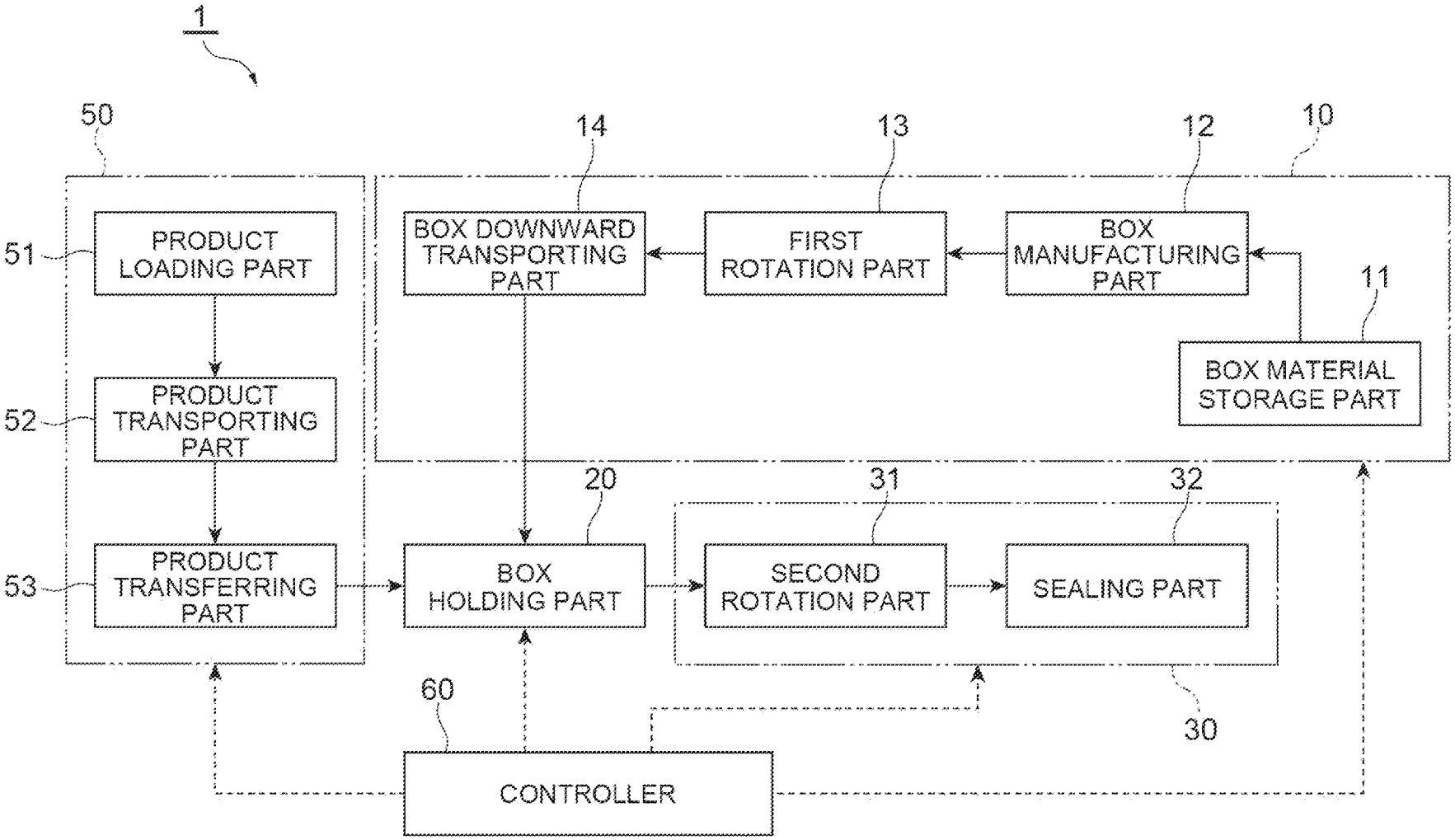
FIG. 1 is a block diagram of a box packing apparatus according to one embodiment of the present disclosure.

First, with reference to FIGS. 1 and 2, the overall configuration of the box packing apparatus 1 of the embodiment will be described. As shown in FIG. 1, the box packing apparatus 1 is an apparatus that assembles (manufactures) a cardboard box B, inserts a plurality of products (articles) A into the cardboard box B, and seals the cardboard box B storing the products A. The box packing apparatus 1 assembles a plurality of pieces of box material Z stored in a box material storage part 11 one by one, and stores a plurality of products A, which are supplied from the outside by the product supply means 50 and are sequentially carried in, in the cardboard box B in an aligned state.

Figure 2:
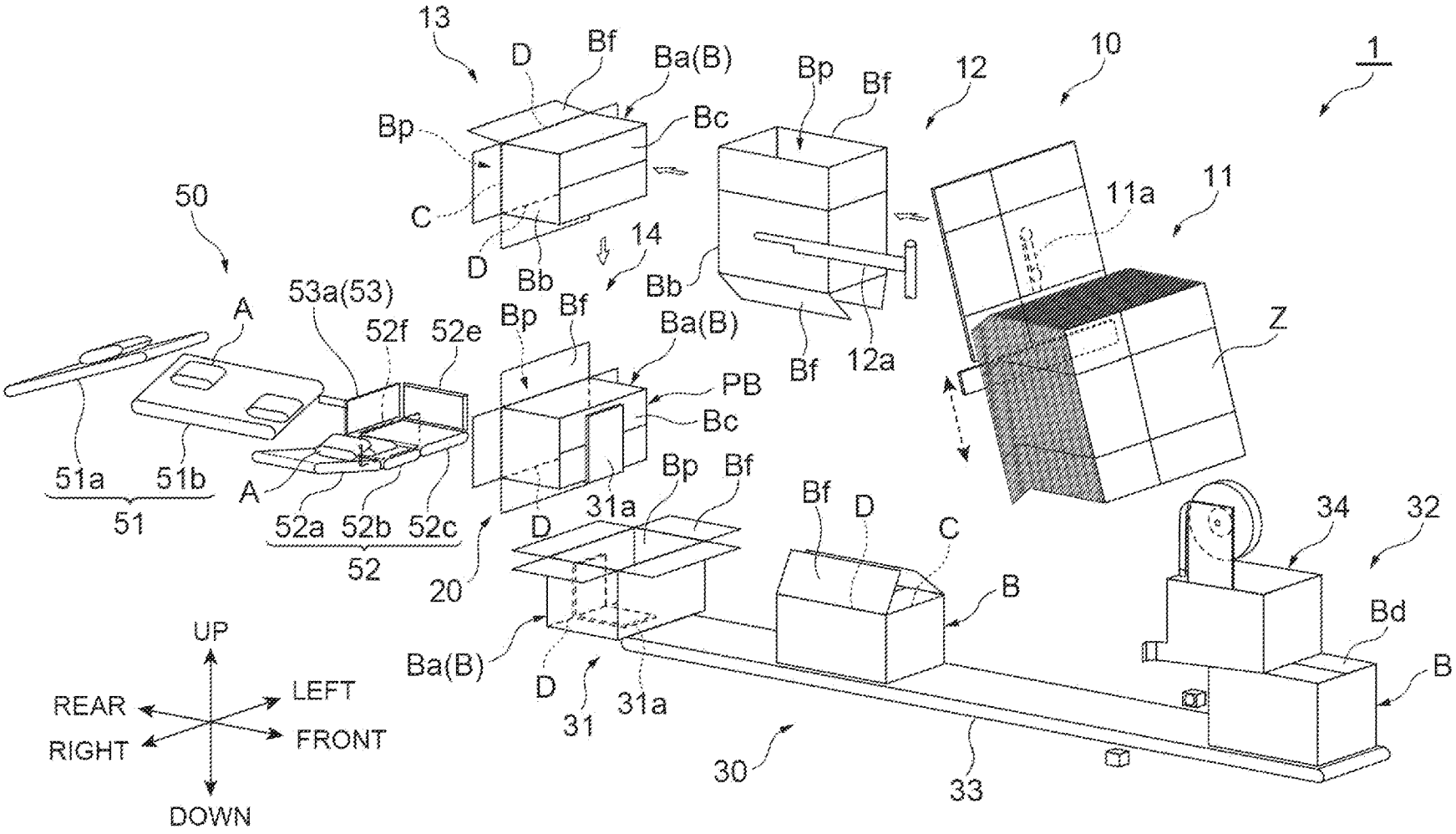
FIG. 2 is a perspective view showing a flow of cardboard boxes and products in the box packing apparatus.
Figure 5A:
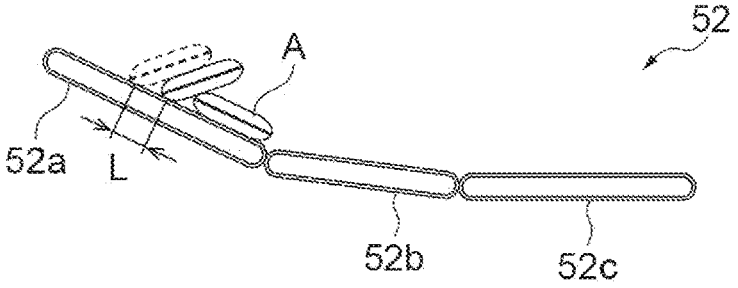
FIGS. 5A to 5E are diagrams showing a procedure for transporting a group of articles by a transport means.
Figure 5B:
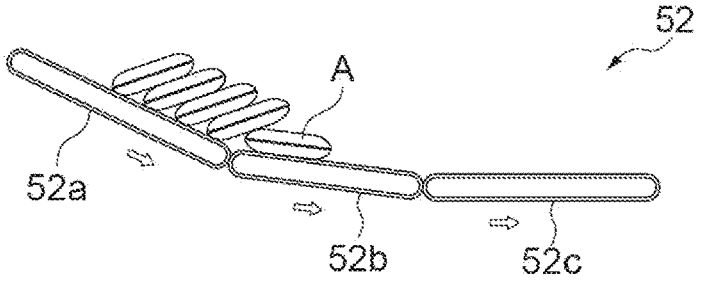
Figure 5C:
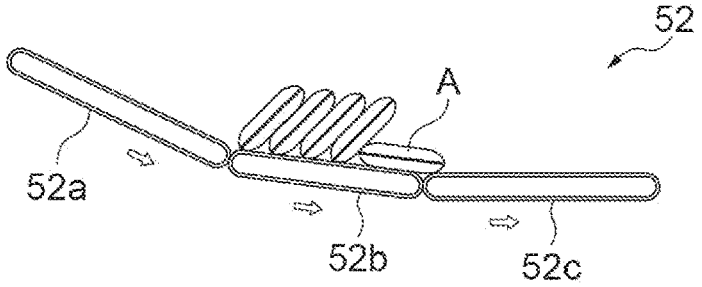
Figure 5D:
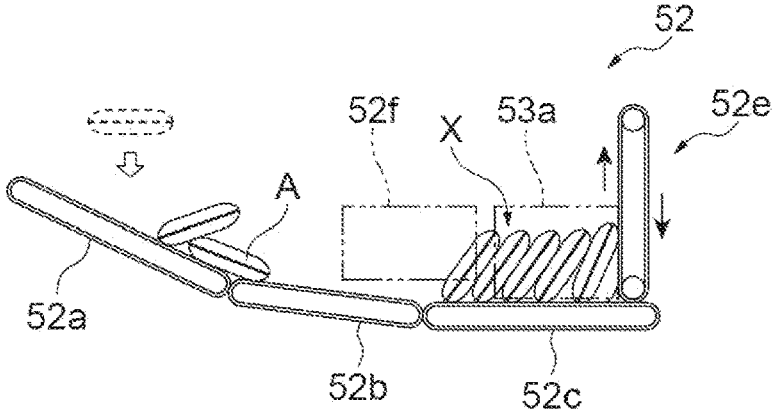
Figure 5E:
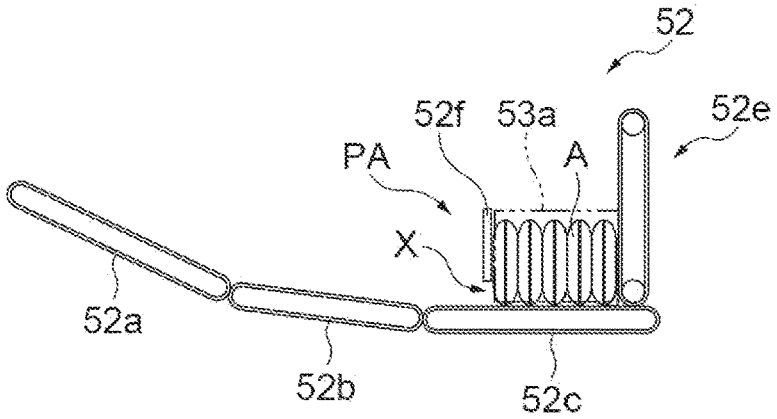

As shown in FIGS. 1 and 2, the box packing apparatus 1 includes a box supply means (a supply means) 10 for assembling the cardboard box B and supplying it to a holding position PB, a box holding part (a holding means) 20 for holding the cardboard box B at the holding position PB, and a box sealing means 30 for transporting and sealing the cardboard box B storing a group of products (a group of articles) X (refer to FIG. 5E). The box packing apparatus 1 further includes a product supply means 50 for sequentially supplying a plurality of products A. Each configuration provided in the box packing apparatus 1 will be described below.

The box supply means 10 is generally provided at an upper and front portion of the box packing apparatus 1. The box supply means 10 includes a box material storage part 11 that stores the plurality of pieces of box material Z, a box manufacturing part 12 that assembles a box main body Ba of the cardboard box B, a first rotation part 13 that rotates the assembled box main body Ba, and a box downward transporting part 14 that transports the box main body Ba downward. The box material storage part 11 is disposed, for example, at a front end of the box packing apparatus 1 and is disposed above a sealing part 32 which will be described below. The box material storage part 11 supports a plurality of pieces of box material Z placed to overlap each other by a support part (not shown). The box material storage part 11 includes a lifting mechanism 11*a* for taking out the pieces of box material Z one by one. Each of the pieces of box material Z taken out by the lifting mechanism 11*a* is transported rearward by a conveyor (not shown). The box manufacturing part 12 receives each of the pieces of box material Z, unfolds the piece of box material Z into a tubular shape, folds a flap Bf on the bottom side, and attaches a tape to a bottom surface Bc. Thus, the box main body Ba is transported further rearward in a posture in which an opening Bp is directed upward. In the present specification, "box manufacturing" of the cardboard box B means that the box main body Ba having a rectangular parallelepiped shape is formed. Therefore, the "box manufacturing" does not necessarily require that the flap Bf on the upper surface side be folded. The box manufacturing part 12 may include a suction rotation mechanism 12*a* that rotates the box main body Ba such that a long side D of the box main body Ba is directed in a transporting direction. A remaining amount of the pieces of box material Z stored in the box material storage part 11 may be monitored by a sensor or the like, and the pieces of box material Z may be automatically replenished according to the remaining amount. The piece of box material Z may be replenished by an operator or the like.

In this specification, the "suction rotation mechanism" may be used at a plurality of locations. The "suction rotation mechanism" includes a main shaft part, a suction part that is connected to the main shaft part and is rotatable about a predetermined axis, and a suction pressure applying means for applying a suction pressure (a negative pressure) to the suction part. The main shaft part and the suction part may be integrally slidable in a horizontal direction or the like by a slide mechanism. In order to rotate the cardboard box B or change the posture of the cardboard box B, a known configuration other than the "suction rotation mechanism" may be used. Naturally, when the box main body Ba is empty and when a group of products X is stored inside the box main body Ba, since a weight of the cardboard box B to be rotated varies, the power or specifications of the "suction rotation mechanism" are determined in consideration of the weight thereof.

The box main body Ba of the cardboard box B has a rectangular parallelepiped shape. That is, the box main body Ba has four sides that extend in the vertical direction in parallel with each other and having the same length in a reference posture in which a top surface Bd (refer to the sealed cardboard box B shown in the lower right of FIG. 2) is directed upward. The box main body Ba has a congruent rectangular top surface Bd and bottom surface Bc. Each of the top surface Bd and the bottom surface Bc includes a pair of short sides C and a pair of long sides D. When a flap Bf is open on the top surface Bd, the box main body Ba has an opening Bp. The opening Bp also includes the pair of short sides C and the pair of long sides D, like the top surface Bd. (Strictly speaking, the top surface Bd and the opening Bp differ by a thickness of the piece of box material Z, but they are not distinguished in the specification.)

Figure 3A:
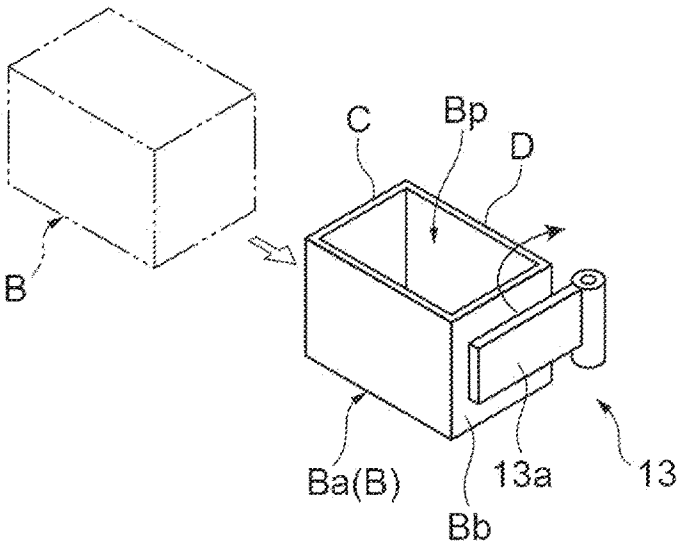
FIGS. 3A to 3C are diagrams showing a procedure for rotating the cardboard box to a first posture by a first rotation part of a supply means.
Figure 3B:
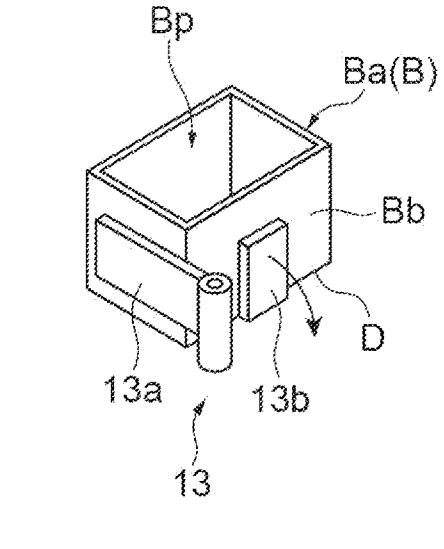
Figure 3C:
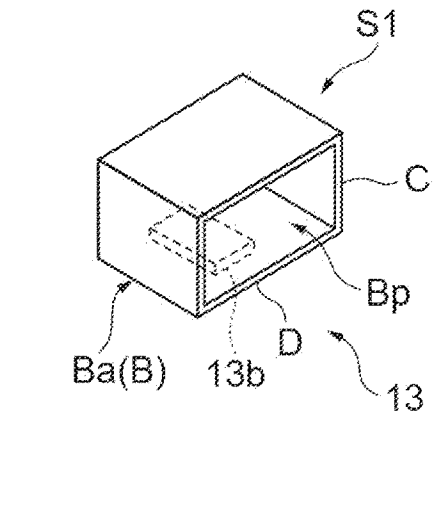
Figure 4B:
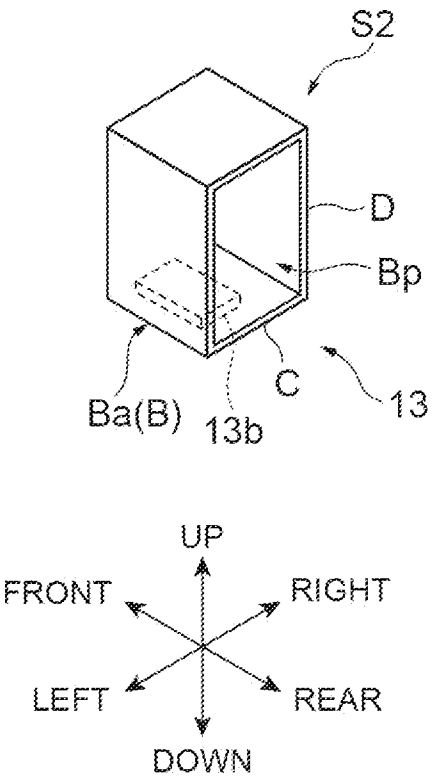
FIGS. 4A and 4B are diagrams showing a procedure for rotating the cardboard box to a second posture by the first rotation part of the supply means.
Figure 4A:
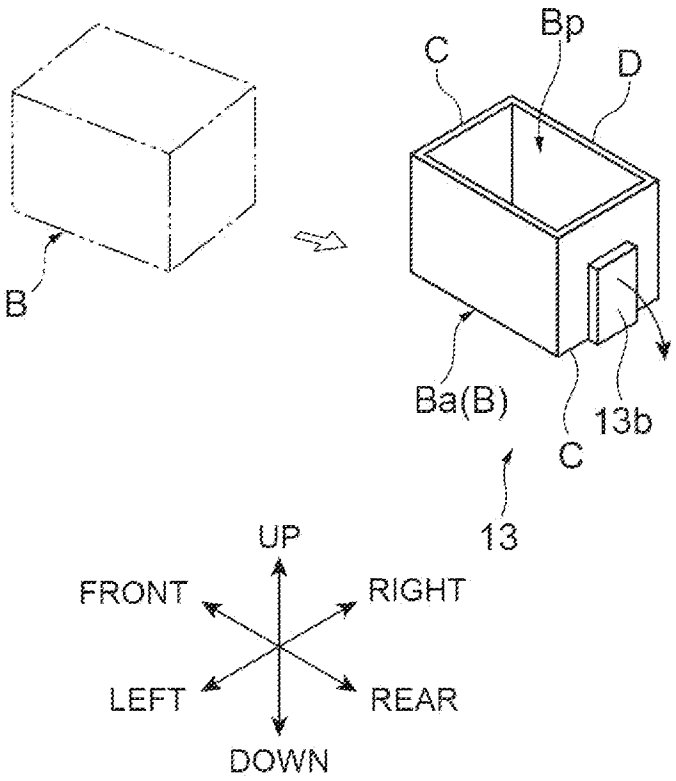

Next, the first rotation part 13 will be described with reference to FIGS. 2, 3A to 3C and 4A to 4B. FIGS. 3A to 3C are diagrams showing a procedure for rotating the cardboard box B to a first posture S1 by the first rotation part 13. FIGS. 4A and 4B are diagrams showing a procedure for rotating the cardboard box B to a second posture S2 by the first rotation part 13. As shown in FIGS. 3A to 4B, the first rotation part 13 rotates the cardboard box B after box manufacturing to a predetermined posture. More specifically, the first rotation part 13 selectively rotates the cardboard box B after box manufacturing to any one of the first posture S1 (refer to FIG. 3C) in which the long side D is located downward and the opening Bp is directed laterally and the second posture S2 (refer to FIG. 4B) in which the short side C is located downward and the opening Bp is directed laterally. To which posture the cardboard box B is to be rotated (or to which posture the cardboard box B is changed) is determined (selected) and controlled by, for example, a controller 60 which will be described below.

As shown in FIGS. 3A to 3C, the first rotation part 13 includes, for example, a first suction rotation mechanism 13*a* that rotates the box main body Ba by 90 degrees about an axis extending in the vertical direction, and a second suction rotation mechanism 13*b* that rotates the box main body Ba by 90 degrees about an axis extending in the left-right direction. First, a side surface Bb on the short side C side (a side surface located on the rear side) is held by the first suction rotation mechanism 13*a*, and the box main body Ba is rotated by 90 degrees (refer to FIGS. 3A and 3B). At this time, the opening Bp is in a state in which it is directed upward. Subsequently, a side surface Bb on the long side D side (a side surface located on the rear side) is held by the second suction rotation mechanism 13*b*, and the box main body Ba is rotated by 90 degrees (refer to FIGS. 3B and 3C). At this time, the opening Bp is directed laterally (rearward).

After the above-described two rotating operations, the posture (orientation) of the box main body Ba becomes the first posture S1 in which the long side D is located downward and the opening Bp is directed laterally (rearward). The rotating operation of the first rotation part 13 is not limited to the above, and the box main body Ba may first be rotated about an axis that extends in the left-right direction and may then be rotated about an axis that extends in the vertical direction. Alternatively, the box main body Ba may be rotated at once by an articulated robot hand or the like having a suction part at a tip end thereof.

As shown in FIGS. 4A and 4B, when the controller 60 determines that the cardboard box B should be rotated to the second posture S2, the box main body Ba is directly transported to a position of the second suction rotation mechanism 13*b* without being rotated by the first suction rotation mechanism 13*a*. The side surface Bb of the short side C (the side surface located on the rear side) of the box main body Ba is held by the second suction rotation mechanism 13*b*, and the box main body Ba is rotated by 90 degrees. At this time, the opening Bp is directed laterally (rearward).

After the rotating operation, the posture (the orientation) of the box main body Ba is the second posture S2 in which the short side C is located downward and the opening Bp is directed laterally (rearward).

In the first rotation part 13, any one of the first posture S1 and the second posture S2 is selected according to a type of the cardboard box B. An example of this selection criterion is whether or not the cardboard box B is of a type compatible with retail display packaging (hereinafter referred to as a retail ready package (RRP)). When the cardboard box B is of the RRP compliant type, the first posture S1 may be selected. Otherwise, the second posture S2 may be selected. In the RRP compliant type cardboard box B, the box main body Ba is formed with breaking lines such as perforations. When the cardboard box B is placed in a store, all or part of the top surface Bd and the side surface Bb on the short side C side (the side surface located at the front when the product is displayed) are removed. Thus, a stored product A is exposed. At this time, the group of products X is stored in advance in the cardboard box B in a predetermined direction so that the front surface of the product A is directed to the side surface on the short side C side.

Figure 6A:
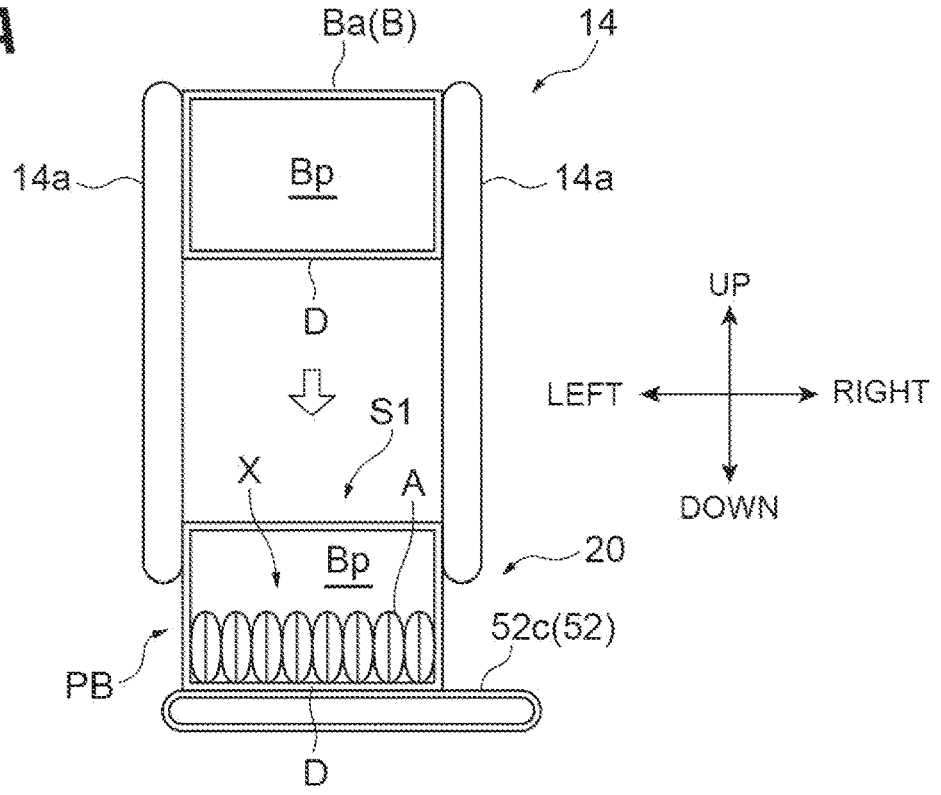
FIG. 6A is a diagram showing transportation of a group of articles to the cardboard box in the first posture.
Figure 6B:
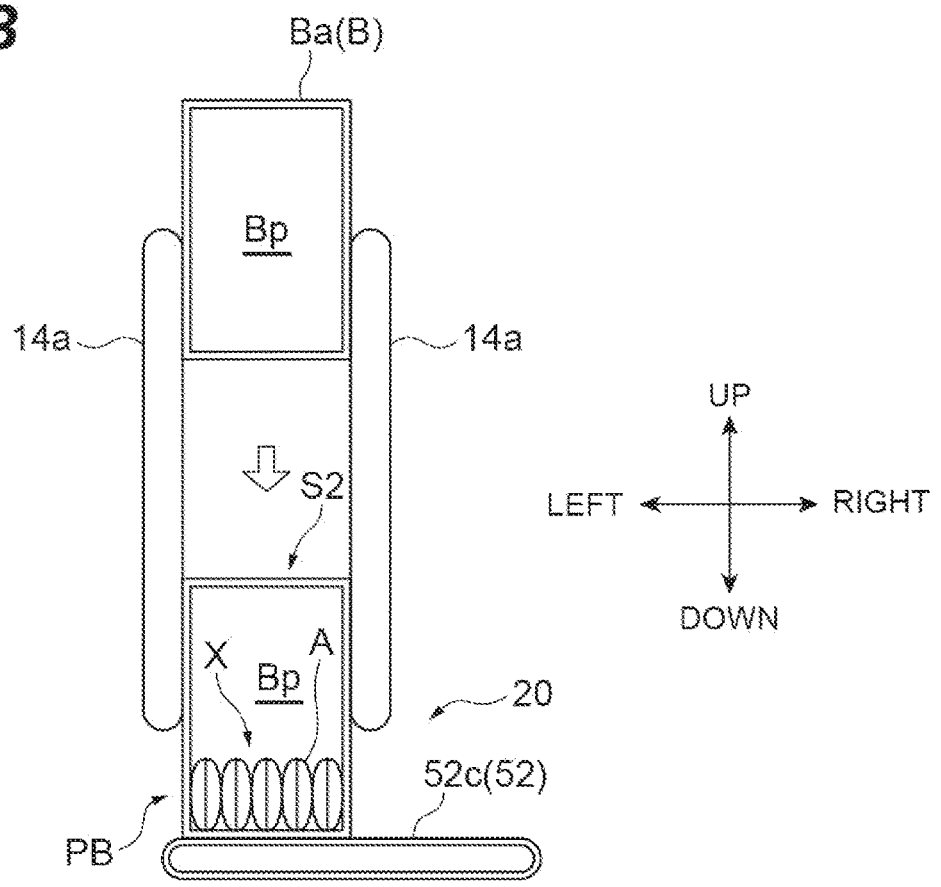
FIG. 6B is a diagram showing transportation of a group of articles to the cardboard box in the second posture.

As shown in FIGS. 1 and 2, the box downward transporting part 14 transports the box main body Ba downward. The box downward transporting part 14 can transport both the box main body Ba in the first posture S1 and the box main body Ba in the second posture S2. The box downward transporting part 14 is disposed at a rear end portion of the box supply means 10. For example, as shown in FIGS. 6A and 6B, the box downward transporting part 14 includes a pair of upward and downward transporting belts 14*a*. The pair of upward and downward transporting belts 14*a* are spaced apart in the left-right direction and move so that a separation distance therebetween can be adjusted. The box downward transporting part 14 can sandwich the box main body Ba with the pair of upward and downward transporting belts 14*a*. The box downward transporting part 14 transports the box main body Ba downward by running the pair of upward and downward transporting belts 14*a*.

As shown in FIGS. 2 and 6A to 6B, the box holding part 20 holds the cardboard box B at a holding position PB. For example, a portion (a lower portion) of the box downward transporting part 14 described above is a holding means for holding the cardboard box B. The box holding part 20 can hold the cardboard box B in the first posture S1 and can also hold the cardboard box B in the second posture S2. In both the first posture S1 and the second posture S2, the opening Bp of the box main body Ba is directed rearward.

Next, the product supply means 50 will be described with reference to FIGS. 1, 2 and 5A to 5E. The product supply means 50 is generally provided at the rear end of the box packing apparatus 1. The product supply means 50 has a product loading part 51, a product transporting part 52, and a product transferring part 53. The product loading part 51 is disposed downstream of, for example, a process for performing weight, sealability, foreign matter contamination inspections, and the like, receives the supply of the products A that have passed the inspections, and delivers each of the products A to the product transporting part 52. The product loading part 51 includes a product introduction conveyor 51*a* and a product loading conveyor 51*b* disposed downstream of the product introduction conveyor 51*a*. Each of the products A is transferred from the product introduction conveyor 51*a* to the product loading conveyor 51*b*, and is transported along a support wall (not shown) on the product loading conveyor 51*b*.

The product transporting part 52 receives each of the products A adjusted to a predetermined posture from the product loading part 51 and forms a group of products X including a plurality of products A. As shown in FIGS. 5A to 5C, the product transporting part 52 includes a first aligning conveyor 52*a* that transports the products A by a predetermined pitch L, a second aligning conveyor 52*b* that receives the plurality of products A from the first aligning conveyor 52*a* in a state in which the products A partially overlap each other, and transports them, and a third aligning conveyor 52*c* that makes the plurality of products A stand to form the group of products X by transporting the plurality of products A toward a standing conveyor 52*e*. When a plurality of products A are aligned on the third aligning conveyor 52*c*, a pressing plate 52*f* disposed near the third aligning conveyor 52*c* may be rotated to push the group of products X toward the standing conveyor 52*e*.

The first aligning conveyor 52*a* and the second aligning conveyor 52*b* are each inclined at a predetermined angle, and the third aligning conveyor 52*c* is disposed horizontally, for example. An inclination angle of each of the first aligning conveyor 52*a* and the second aligning conveyor 52*b* may be adjustable. As shown in FIG. 5D, when the group of products X is formed on the third aligning conveyor 52*c*, the next products A are sequentially supplied onto the first aligning conveyor 52*a*, and some of the products A are being transferred to the second aligning conveyor 52*b*. A mechanism for forming the group of products X in the product transporting part 52 can be realized by the known structure and method described in Patent Document 1, for example.

The product transporting part 52 is a transport means that transports the group of products X, in which at least some of the products A (all or some) are arranged to overlap each other, to a predetermined position PA. As shown in FIG. 5E, rows of the group of products X configured of the plurality of products A are arranged in a row in the left-right direction. The number of products A included in the group of products X formed by the product transporting part 52 is controlled by the controller 60 in accordance with the selection of the posture (the first posture S1 or the second posture S2) of the first rotation part 13 described above. The number of products A is relatively great when the first posture S1 is selected, and the number of products A is relatively small when the second posture S2 is selected.

The group of products X is held at a predetermined position PA by the product transporting part 52, and the predetermined position PA faces the predetermined position PA of the cardboard box B by the box holding part 20 in the forward-rearward direction. That is, a height of the predetermined position PA and a height of a holding position PB (strictly speaking, a height of a space in which the group of products X should be inserted in the cardboard box B) are equal.

The product transferring part 53 is a transfer means for transferring the group of products X from the predetermined position PA to the inside of the box main body Ba (inside the cardboard box B). As shown in FIGS. 2 and 5E, the product transferring part 53 includes a transfer plate 53*a* that includes a plate-like portion directed to the front surface and is slidable in the forward-rearward direction. The transfer plate 53*a* is driven by the controller 60, and when the holding of the cardboard box B by the box holding part 20 and the formation of the group of products X by the product transporting part 52 are completed, the transfer plate 53*a* moves forward to push (transfer) the group of products X into the box main body Ba.

The transfer of the group of products X according to the posture (the first posture S1 or the second posture S2) of the cardboard box B will be described. As shown in FIG. 6A, when the box main body Ba is held with the long side D being located downward (in the case of the first posture S1), the group of products X including, for example, eight products A is formed in the product transporting part 52. The number of products in this case corresponds to a length of the long side D of the box main body Ba. The product transferring part 53 transfers the group of products X forward in a state in which the rows of the group of products X are aligned in a row along the long side D of the box main body Ba, and stores the group of products X in the box main body Ba through the opening Bp. In this way, when the cardboard box B is held in the first posture S1, the number of products A stored at one time is relatively great.

As shown in FIG. 6B, when the box main body Ba is held with the short side C being located downward (in the case of the second posture S2), a group of products X including, for example, five products A is formed in the product transporting part 52. The number of products in this case corresponds to a length of the short side C of the box main body Ba. The product transferring part 53 transfers the group of products X forward in a state in which the rows of the group of products X are arranged in a row along the short side C of the box main body Ba, and stores the group of products X in the box main body Ba through the opening Bp. In FIGS. 6A and 6B, illustration of the standing conveyor 52*e* is omitted.

Figure 7:
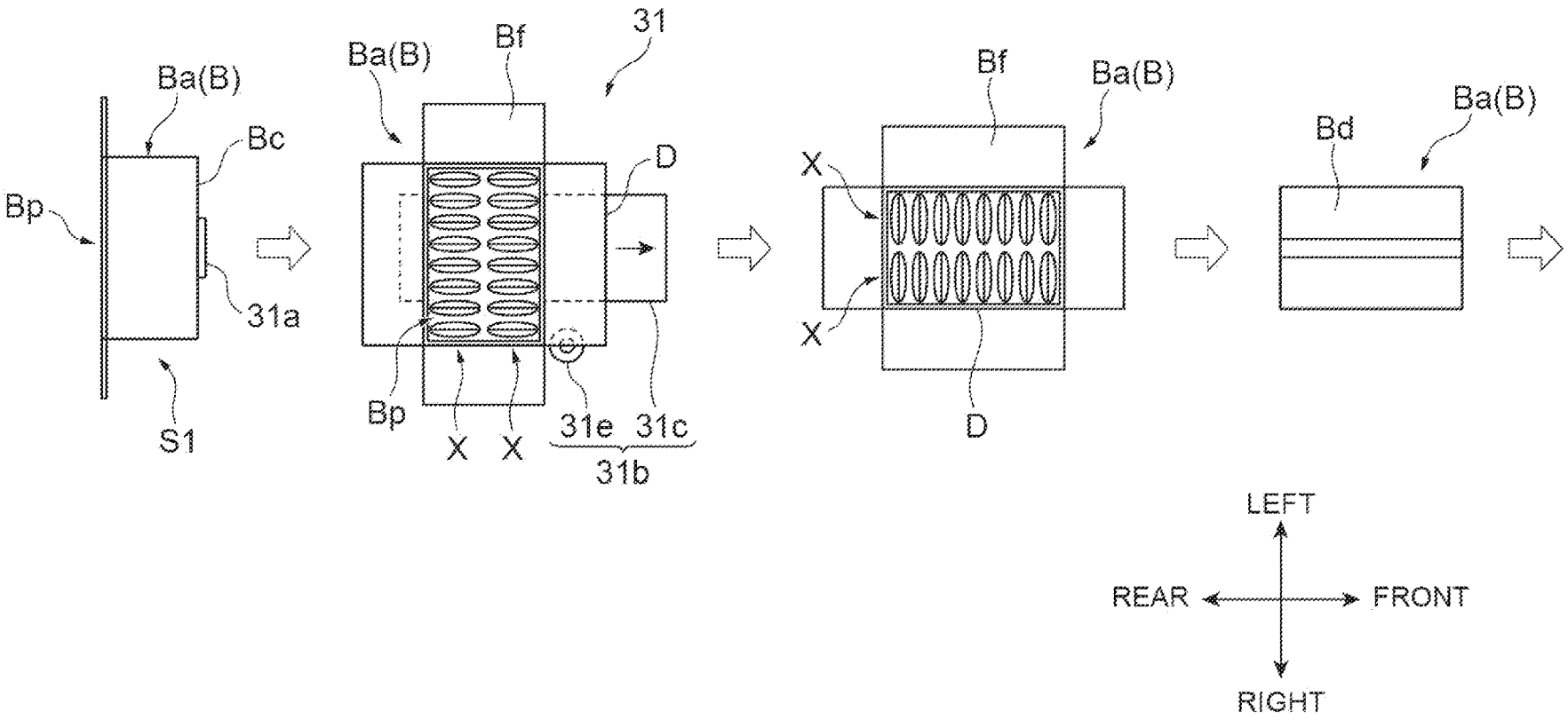
FIG. 7 is a diagram showing a procedure for rotating the cardboard box by a second rotation part of a box sealing means.

Next, the box sealing means 30 will be described with reference to FIGS. 1, 2 and 7. The box sealing means 30 is generally provided at the front lower portion of the box packing apparatus 1. The above-described box holding part 20 is disposed at an intermediate position between a rear end portion of the box supply means 10 and a rear end portion of the box sealing means 30 located below it. FIG. 7 illustrates a case in which the box main body Ba is held in the first posture S1. For example, a bottom surface Bc is held by the suction rotation mechanism 31*a*, and the suction rotation mechanism 31*a* is further lowered, so that the box main body Ba storing the group of products X reaches an entrance of the box sealing means 30.

As shown in FIGS. 1 and 2, the box sealing means 30 includes a second rotation part 31 that rotates the box main body Ba storing the group of products X, a discharge conveyor 33 that transports the box main body Ba forward, and a sealing part 32 that acts on the box main body Ba on the discharge conveyor 33, closes the opening Bp with a flap Bf, and applies a tape. As shown in FIG. 7, the second rotation part 31 includes a suction rotation mechanism 31*a* that rotates the box main body Ba by 90 degrees about an axis extending in the left-right direction, and a transport rotation mechanism 31*b* that rotates the box main body Ba by 90 degrees about an axis extending in the vertical direction. First, the bottom surface Bc is held by the suction rotation mechanism 31*a*, and the box main body Ba is rotated by 90 degrees. At this time, the opening Bp is directed upward. The second rotation part 31 includes an eccentric conveyor 31*c* that supports the box main body Ba at a position shifted (eccentrically) from the center of gravity of the box main body Ba and transports the box main body Ba forward, and a restriction roller 31*e* that stands upright on the right side of the eccentric conveyor 31*c* and is in contact with a corner portion of the box main body Ba to restrict forward movement of the contact portion. A left side portion of the box main body Ba is transported forward by the eccentric conveyor 31*c*, and at this time, a right side portion of the box main body Ba is pressed by the restriction roller 31*e*, and thus the box main body Ba is rotated by 90 degrees. Thus, the long side D of the box main body Ba is directed in the transporting direction of the discharge conveyor 33.

In this way, the second rotation part 31 rotates the cardboard box B so that the application direction in which the tape is applied by the sealing part 32 is aligned with the transporting direction of the cardboard box B. More specifically, when the cardboard box B is held in the first posture S1, the transport rotation mechanism 31*b* rotates the cardboard box B by 90 degrees about an axis extending in the vertical direction so that the long side D is directed to the transporting direction.

The rotation mechanism in the second rotation part 31 is not limited to the above example, and various other known mechanisms may be employed. For example, in the second rotation part 31, a turntable mechanism may be used instead of the transport rotation mechanism 31*b*. Alternatively, in the second rotation part 31, a suction rotation mechanism similar to that of the box manufacturing part 12 may be used in place of the transport rotation mechanism 31*b*.

As shown in FIG. 2, the sealing part 32 folds the flap Bf on the top surface side of the box main body Ba transported by the discharge conveyor 33 and applies a tape to the top surface Bd. The direction in which the tape is applied by a tape applying part 34 is the same as the transporting direction of the discharge conveyor 33. A well-known mechanism may be employed for the tape applying part 34 as well, for example, the mechanism described in Patent Document 1 may be employed. The sealed cardboard box B is discharged from the front end portion of the box packing apparatus 1.

As shown in FIG. 1, the box packing apparatus 1 includes a controller 60 that controls the operations of each of the units of the box supply means 10, the box holding part 20, the box sealing means 30, and the product supply means 50. That is, the controller 60 is a circuit configured to control the operations of each of the units of the box supply means 10, the box holding part 20, the box sealing means 30, and the product supply means 50. The controller 60 is configured as a computer device including a processor such as a CPU, memories such as ROM and RAM, a storage and a communication device, and the like. In the controller 60, the processor executes predetermined software (a program) read by a memory or the like, and a variety of control described above is realized by controlling reading and writing of data in the memory and storage, and the communication by a communication device.

According to the box packing apparatus 1 of the embodiment, the cardboard box B is held in the first posture S1 in which the long side D is located downward, unlike the conventional box packing apparatus. Then, the rows of the group of products X are stored in a row along the long side D of the cardboard box B by the product transferring part 53 (refer to FIG. 6A). The number of products A stored at one time is greater than before, and the number of stages is reduced because it corresponds to the short side C. Therefore, in the box packing apparatus 1, the box packing capacity can be enhanced by making it possible to pack the products A arranged in the direction of the long side D.

The box supply means 10 has the first rotation part 13 that selectively rotates the cardboard box B after box manufacturing to the first posture S1 or the second posture S2. The cardboard box B can be rotated into two different postures by the first rotation part 13. Therefore, variations regarding the form of box packing are widened. For example, when the box packing apparatus 1 handles RRP compliant cardboard boxes B, the controller 60 performs box packing for the RRP in which the front surface of the product A is directed to the side surface on the short side C side (refer to FIG. 6A). Otherwise, the controller 60 performs conventional box packing in which the orientation of the product A is different from the box packing for the RRP by 90 degrees (refer to FIG. 6B).

In the first rotation part 13, any one of the first posture S1 and the second posture S2 is selected according to the type of the cardboard box B. The appropriate orientation in which the rows of the group of products X should be arranged may vary according on the type of the cardboard box B and the type of the product A. According to the above configuration, the box packaging is performed in an appropriate manner.

The box sealing means 30 has a second rotation part 31 that rotates the cardboard box B so that the transporting direction of the cardboard box B is aligned with the application direction in which the tape is applied. According to the second rotation part 31, in the case of the box packaging in which products A are arranged in direction of the long side D, the tape can be easily applied as in the conventional case.

In this regard, assuming a form that does not include the second rotation part 31, when the cardboard box B is simply rotated 90 degrees about the axis extending in the left-right direction from the first posture S1 shown at the left end of FIG. 7, the long side does not coincide with (perpendicular to) the transporting direction. In this case, there is a problem that it becomes difficult to apply the tape. According to the second rotation part 31, such a problem is solved, and the application of the tape is facilitated.

When the cardboard box B is held in the first posture S1, the second rotation part 31 rotates the cardboard box B by 90 degrees about the axis extending in the vertical direction so that the long side D is directed in the transporting direction. This configuration eliminates the need to change the discharge conveyor 33 and the sealing part 32 that are provided in the conventional apparatus. Therefore, changes from the conventional apparatus are minimized.

Although an embodiment of the present disclosure has been described above, the present invention is not limited to the above embodiment. For example, the rotation (the rotation shown in FIG. 7) for aligning the application direction with the transporting direction by the second rotation part 31 may be omitted. In that case, the transport rotation mechanism 31*b* can be omitted. The sealing part includes a mechanism for applying a tape in a direction orthogonal to the transporting direction.

Further, the first rotation part 13 may rotate the posture of the cardboard box B only to the first posture S1 (for example, when the box packing apparatus 1 is an RRP-dedicated apparatus, or the like). In that case, the controller 60 does not need to select the posture corresponding to the type of cardboard box.

In the box packing apparatus 1, the box supply means 10 may be omitted. In the box packing apparatus 1, the box sealing means 30 may be omitted. The configuration of the product supply means 50 may be appropriately changed from the above embodiment. At least some of the embodiments described above may be combined arbitrarily with respect to each of the holding means, the supply means and the transfer means.

What is claimed is:

1. A box packing apparatus, comprising:

a transport unit configured to transport a group of articles arranged in a state in which at least some of the articles overlap with each other to a predetermined position;

a holding unit configured to hold a cardboard box having an opening with long sides and short sides;

a transfer unit configured to transfer the group of articles from the predetermined position into the cardboard box; and a supply unit configured to supply the cardboard box to a holding position at which the cardboard box is held by the holding unit;

wherein the supply unit includes a first rotation part that selectively rotates the cardboard box after box manufacturing to a first posture in which the long side is located downward and the opening is directed laterally or to a second posture in which the short side is located downward and the opening is directed laterally, the holding unit is configured to hold the cardboard box in the first posture or the second posture, and the transfer unit transfers the group of articles in a first state in which rows of the group of articles are arranged in a row along the long side of the cardboard box or in a second state in which the rows of the group of articles are arranged in a row along the short side of the cardboard box.

2. The box packing apparatus according to claim 1, wherein, in the first rotation part, either the first posture or the second posture is selected according to a type of the cardboard box.

3. The box packing apparatus according to claim 2, further comprising a box sealing unit configured to close the opening of the cardboard box storing the group of articles with a flap and to apply a tape, wherein the box sealing unit includes a second rotation part that rotates the cardboard box so that a transporting direction of the cardboard box is aligned with an application direction in which the tape is applied.

4. The box packing apparatus according to claim 3, wherein, when the cardboard box is held in the first posture, the second rotation part rotates the cardboard box by 90 degrees about an axis extending in a vertical direction so that the long side is directed in the transporting direction.

5. The box packing apparatus according to claim 1, further comprising a box sealing unit configured to close the opening of the cardboard box storing the group of articles with a flap and to apply a tape, wherein the box sealing unit includes a second rotation part that rotates the cardboard box so that a transporting direction of the cardboard box is aligned with an application direction in which the tape is applied.

6. The box packing apparatus according to claim 5, wherein, when the cardboard box is held in the first posture, the second rotation part rotates the cardboard box by 90 degrees about an axis extending in a vertical direction so that the long side is directed in the transporting direction.

* * * * *